United States Patent [19]

Koutaka

[11] Patent Number: 5,004,880

[45] Date of Patent: Apr. 2, 1991

[54] CLICK-TYPE PUSH BUTTON SWITCH WITH IMPROVED LEAF SPRING

[75] Inventor: Yoshirou Koutaka, Iwaki, Japan

[73] Assignee: Alps Electric Co., Ltd., Tokyo, Japan

[21] Appl. No.: 560,509

[22] Filed: Jul. 20, 1990

Related U.S. Application Data

[63] Continuation of Ser. No. 348,616, May 5, 1989, abandoned.

[30] Foreign Application Priority Data

Jul. 25, 1988 [JP] Japan ..... 63-97345[U]

[51] Int. Cl.[5] ..... H01H 13/02

[52] U.S. Cl. ..... 200/521; 200/308

[58] Field of Search ..... 200/284, 308, 341, 521, 200/533, 535; 400/491.3

[56] References Cited

U.S. PATENT DOCUMENTS 4,467,160 8/1984 Murmann et al. ..... 200/533

FOREIGN PATENT DOCUMENTS 28000 5/1981 European Pat. Off. ..... 200/533

2166986 10/1988 United Kingdom .

*Primary Examiner*—Renee S. Luebke

*Attorney, Agent, or Firm*—Guy W. Shoup; David W. Heid

[57] ABSTRACT

A push button switch including a casing unit composed of an upper casing and a lower casing, a switch device provided in the casing unit, a stem slidably supported to the casing unit for switching on and off the switch device, an elastic member for normally elastically biasing the stem in such a direction as to restore an initial condition of the stem, and a clicking leaf spring adapted to abut against the stem for giving a click feeling to an operator upon depression of the stem. The clicking leaf spring is made up of a base portion having opposite ends abutting against opposed inner surfaces of the upper casing and the lower casing and thereby being held between the upper casing and the lower casing, and a spring portion split from the base portion by a pair of slits each having a closed end. A spring fulcrum is defined by the straight-line distance between the closed ens. The spring portion is such that it is removed from both the upper casing and the lower casing. Upon depression of the stem, the spring portion of the leaf spring is elastically deformed at the spring fulcrum thus increasing a deformation span of the spring portion.

1 Claim, 4 Drawing Sheets

CLICK-TYPE PUSH BUTTON SWITCH WITH IMPROVED LEAF SPRING

This application is a continuation of application No. 07/348,616, filed May 5, 1989 and now abandoned.

BACKGROUND OF THE INVENTION

The present invention relates to a push button switch for use with various input devices of a computer, word processor, etc.

A related conventional push button switch is disclosed in Japanese Utility Model Laid-open Publication No. 61-23238, for example, as shown in FIGS. 6 and 7.

Referring to FIG. 6 which is a vertical sectional view of this prior art push button switch, the push button switch is constructed primarily of a casing unit 1 composed of an upper casing 2 and a lower casing 3, a stem 5 slidably supported by the upper casing 2 and partially projecting from an upper opening 4 of the upper casing 2, a compression spring 6 interposed between the lower casing 3 and the stem 5, a switch device 7 adapted to be switched on and off in association with sliding motion of the stem 5, and a clicking leaf spring 8 having a free end abutting against the stem 5 during the sliding motion of the stem 5 for giving a click feeling to an operator.

As shown in FIG. 7, the clicking leaf spring 8 is comprised of a base portion 9 which is in contact with an inner side surface of the upper casing 2, and a spring portion 10, formed by bending the clicking leaf spring at an upper end of the base portion 9 such that spring portion 10 extends obliquely downward to contact stem 5. At the free end of spring portion 10 is formed a pair of stepped portions 11 for giving a click feeling to the operator. The base portion 9 is formed at its opposite sides with a pair of elastic projections 12 adapted to elastically abut against inner surfaces of grooves (not shown) formed in the upper casing 2, so that the base portion 9 is securely held against the inner side surface of the casing 2. The elastic projections 12 are formed by deforming a pair of tabs split from a central portion of the base portion 9 forming a pair of vertical slits between the projections 12 and the base portion 9. As shown in FIG. 6, a bent portion 14 formed between the base portion 9 and the spring portion 10 abuts against an inner surface of the upper casing 2, and a lower end of the base portion 9 abuts against an inner surface of the lower casing 3. Thus, the base portion 9 is bracketed between the upper and lower casings 2 and 3 and thus prevented from moving along its length.

In operation, when the stem 5 is depressed from its rest position shown in fig. 6, a plate portion 16 of the switch device 7 is elastically deformed in a counterclockwise direction as viewed in fig. 6 (in the direction as depicted by arrow A), while the spring portion 10 of the clicking leaf spring 8 is also elastically deformed in a clockwise direction as viewed in fig. 6 (in the direction as depicted by arrow B). When the stem 5 is further depressed to reach a position near a lowermost position, contacts (not shown) of the switch device 7 are closed by the deformation of the plate portion 16. At the same time, the lower end of the stem 5 is brought into abutment against the stepped portions 11 of the spring portion 10, and rides over the same, causing a change in depression force and thereby giving a click feeling to the operator.

Such a click feeling depends on an elastic modulus of the clicking leaf spring 8 itself and a span $S_1$ between the bent portion 14 and the stepped portions 11. Therefore, when the push button switch is made more compact, the span $S_1$ is reduced to naturally cause an increase in spring force of the spring portion 10. The increased spring force can cause both the breakage of the portion of stem 5 in contact with the stepped portion 11, and increased friction wear between the stem 5 and slide path defined by casing 1.

To cope with this problem, it has been considered to reduce the thickness of the clicking leaf spring 8, so as to reduce the spring force and therefore reduce the elastic modulus. However, although a suitable spring force can be obtained by reducing the thickness of the leaf spring 8, the mechanical strength of the leaf spring 8 is reduced and generates a possibility of breakage due to repeated stress.

SUMMARY OF THE INVENTION

Accordingly, it is an object of the present invention to provide a push button switch which may be made compact and ensure a high reliability and a good operating feeling.

According to the present invention, there is provided in a push button switch including a casing unit composed of an upper, or first casing and a lower, or second, casing, a switch device provided in said casing unit, a stem slidably supported by said casing unit for switching on and off said switch device, biasing means for normally elastically biasing said stem in such a direction as to restore an initial condition of said stem, and a clicking leaf spring adapted to abut against said stem for giving a click feeling to an operator upon depression of said stem; an improvement wherein said clicking leaf spring comprises a base portion having opposite ends abutting against opposed inner surfaces of said upper casing and said lower casing and thereby being held between said upper casing and said lower casing, and a spring portion split from said base portion by a pair of slits having closed ends, the straight-line distance between said closed ends defining a spring fulcrum said spring portion being bent such that said spring portion is removed from both said upper casing and said lower casing.

With this arrangement, when the stem is depressed, the spring portion of the clicking leaf spring is deformed from the spring fulcrum formed between the bottoms of the pair of slits. That is, since the spring portion is bent at a position not contacting both the upper casing and the lower casing, the elastic deformation starts from the spring fulcrum rather than the bent portion. Therefore, the deformation span to be defined as a length between the spring fulcrum and the abutting end of the spring portion abutting against the stem may be increased, thereby obtaining a suitable spring force of the spring portion in spite of an increase in thickness of the spring portion.

Other objects and features of the invention will be more fully understood from the following detailed description and appended claims when referenced with the accompanying drawings.

DETAILED DESCRIPTION OF THE PREFERRED EMBODIMENT

Figure 5:
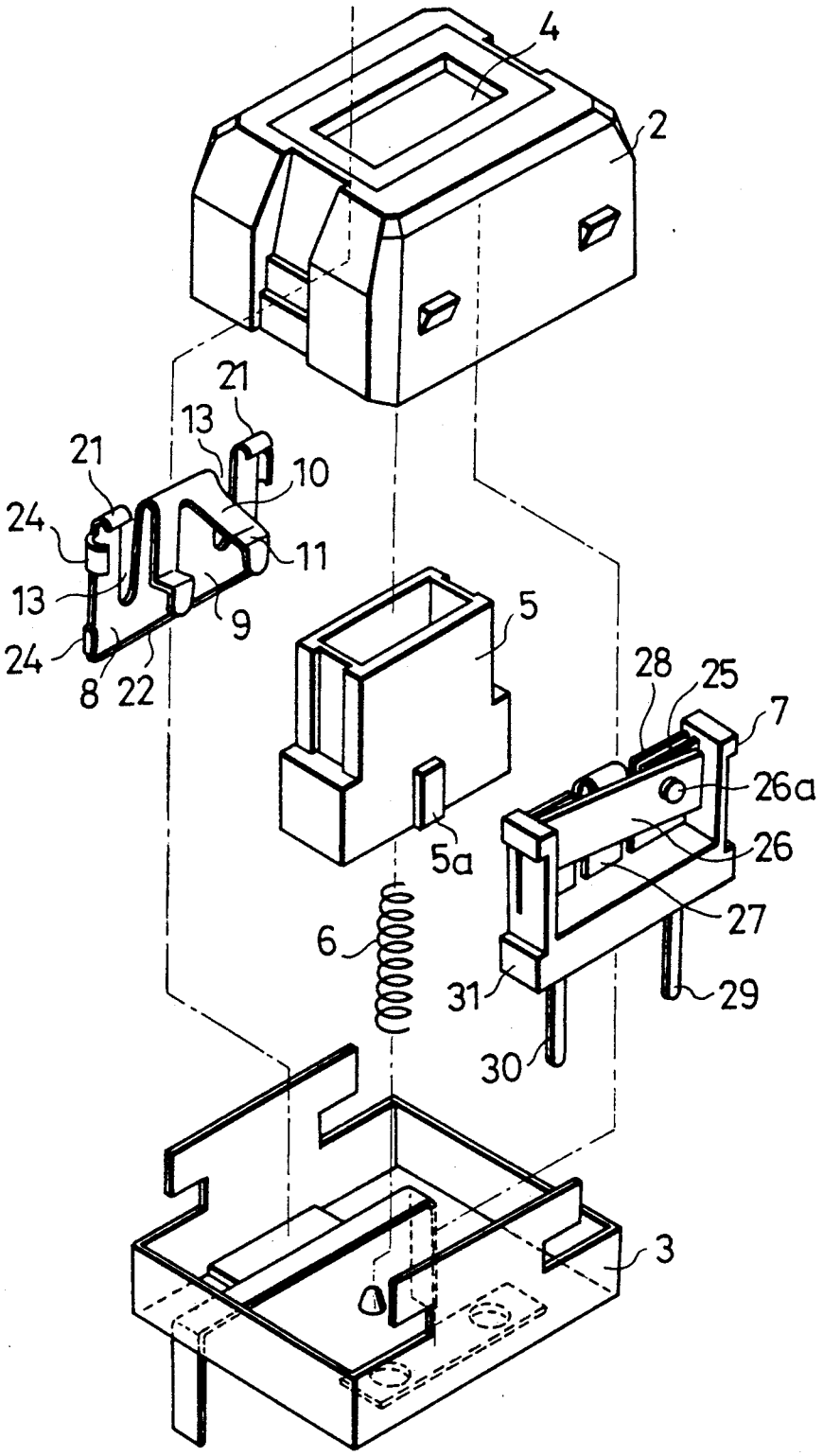
FIG. 5 is an exploded perspective view of the push button switch.
Figure 6:
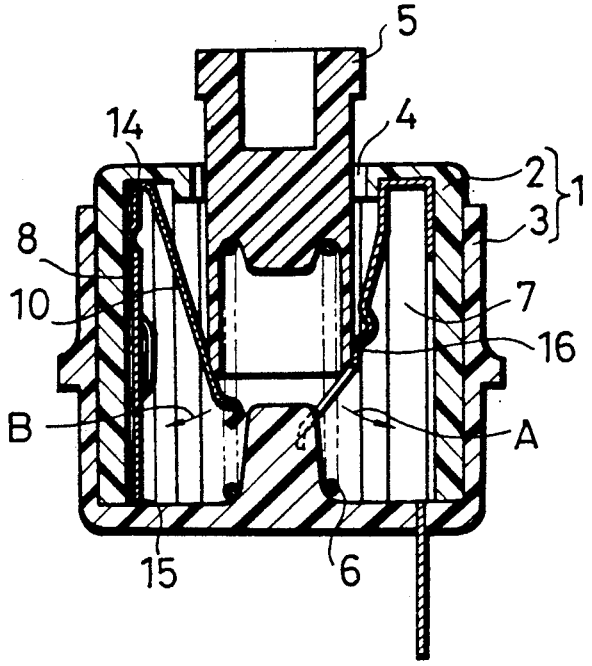
Fig. 6 PRIOR ART
FIG. 6 is a vertical sectional view of the conventional push button switch under an initial condition thereof.
Figure 7:
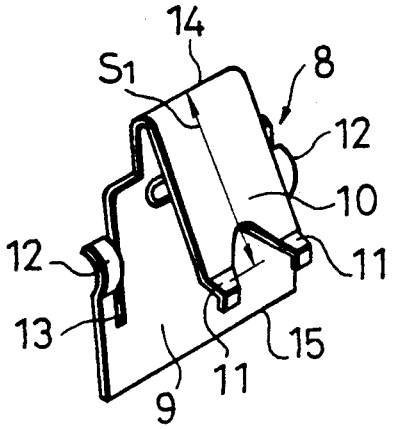
Fig. 7 PRIOR ART
FIG. 7 is a perspective view of the clicking leaf spring shown in FIG. 6.

There will now be described a preferred embodiment of the present invention with reference to FIGS. 1 to 5 wherein the same or corresponding parts as in FIGS. 6 and 7 are designated by the same reference numerals.

The push button switch of the present invention has substantially the same construction as of the prior art push button switch as previously mentioned, including a casing unit 1 composed of an upper, or first, casing 2 and lower, or second, casing 3 a stem 5, a compression spring 6, a switch device 7 and a clicking leaf spring 8.

Figure 3:
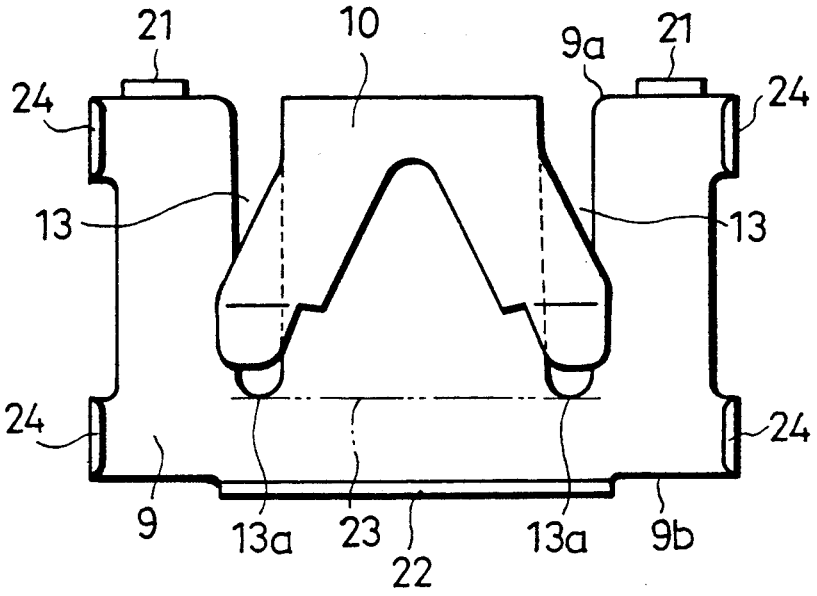
FIG. 3 is an elevational view of the clicking leaf spring.
Figure 4:
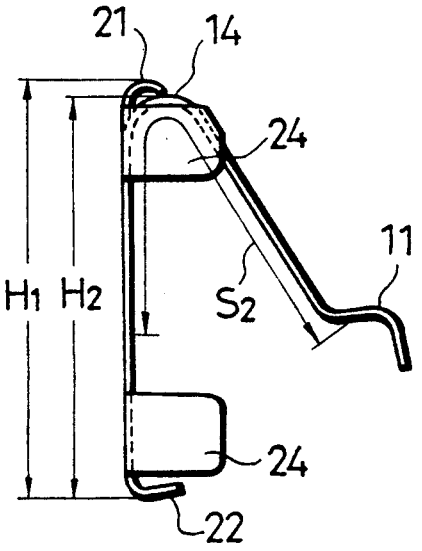
FIG. 4 is a left side view of FIG. 3.

As shown in FIGS. 3 and 4, the clicking leaf spring 8 is integrally composed of a base portion 9 and a spring portion 10 which are split by a pair of relatively wide slits 13. The base portion 9 has opposite upper ends 9*a* formed with a pair of inwardly curved portions 21 adapted to elastically abut against an inner surface of the upper casing 2. The base portion 9 also has a lower end 9*b* formed with an inwardly curved portion 22 adapted to elastically abut the inner surface of the lower casing 3. Thus, the base portion 9 is bracketed in the casing unit 1, preventing sliding in a vertical direction. The pair of slits 13 extend from the upper ends 9*a* toward the lower end 9*b*, and terminate at bottoms 13*a* with a given depth, so that a spring fulcrum 23 of the spring portion 10 is defined by the straight-line distance connecting the pair of bottoms 13*a* of the slits 13. That is, the spring portion 10 is elastically deformed primarily at the spring fulcrum 23 as will be hereinafter described.

As shown in FIG. 4, the spring portion 10 is bent such that the uppermost portion of the bent portion 14 is a shorter distance from the lowermost portion of the base portion 9 (H2) than the distance from the uppermost portion of the inwardly curved portion 21 to the lowermost portion of the base portion 9 (H1). In other words, when the leaf spring 8 is installed into the casing unit 1, the bent portion 14 of the spring portion 10 is removed from the inner surface of the upper casing 2 of the casing unit 1. In the same manner as the prior art switch, the spring portion 10 is formed at its free end portion to form a pair of stepped portions 11. Further, the base portion 9 is formed at its opposite side edges with four inwardly curved portions 24 adapted to elastically abut against the inner surface of the upper casing 2, so that the base portion 9 may be fixedly positioned in the upper casing 2 with respect to a lateral direction.

Figure 1:
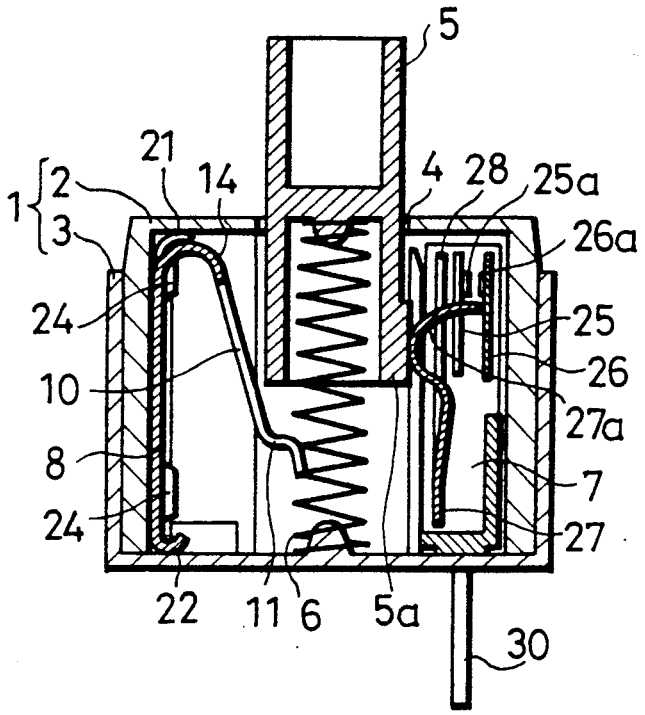
FIG. 1 is a vertical sectional view of the push button switch according to the present invention, under an initial or off-condition thereof.
Figure 2:
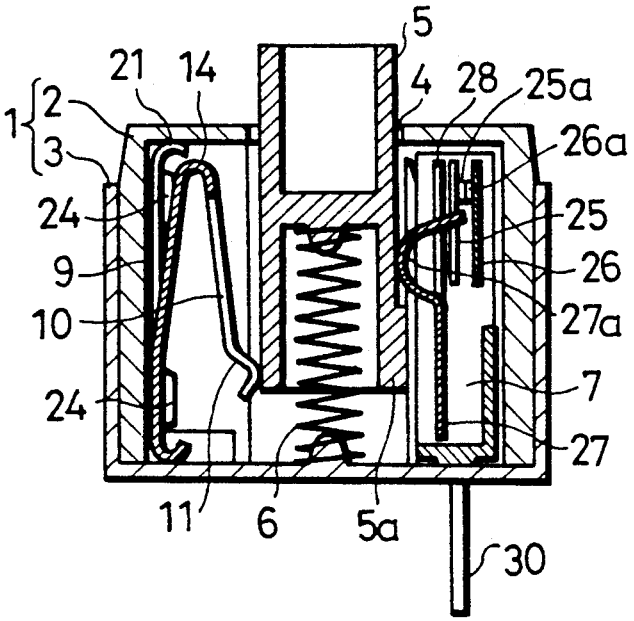
FIG. 2 is a view similar to FIG. 1, under an on-condition of the push button switch where the stem is depressed.

As shown in FIGS. 1, 2 and 5, the switch device 7 includes a fixed contact plate 25 and a movable contact plate 26, both formed of an elastic material and a having fixed and movable contacts 25*a* and 26*a*, respectively, a driving plate 28 having a spring plate portion 27 for driving the movable contact plate 26, and a pair of terminals 29 and 30 connected to the fixed and movable contact plates 25 and 26, respectively. These elements of the switch device 7 are integrally molded by insert molding to form a mold member 31 adapted to be fittedly installed in the casing unit 1. FIG. 1 shows an initial or rest condition of the stem 5, wherein a projection 27*a* of the spring plate portion 27 of the switch device 7 is in elastic abutment against a projection 5*a* of the stem 5. Accordingly, the spring plate portion 27 is elastically deformed to urge the movable contact plate 26 and thereby open the contacts 25*a* and 26*a*, thus establishing an off-state of the switch device 7. On the other hand, when the stem 5 is depressed as shown in FIG. 2, the abutment between the projection 5*a* of the stem 5 and the projection 27*a* of the spring plate portion 27 is released to restore an unloaded condition of the spring plate portion 27 and thereby allow the same to separate from the movable contact plate 26. As a result, the contacts 25*a* and 26*a* are closed to establish an on-state of the switch device 7.

In assembling the push button switch as mentioned above, the stem 5, the switch device 7 and the clicking leaf spring 8 are installed into the upper casing 2, and the compression spring 6 is set below the stem 5. Then, the lower casing 3 is externally engaged with the upper casing 2 from the open underside thereof in a snap-fit fashion. At this point, the base portion 9 of the clicking leaf spring 8 is vertically positioned between the upper casing 2 and the lower casing 3 by the elastic abutment between the upper abutting portions 21 and the upper casing 2 and between the lower abutting portion 22 and the lower casing 3. Further, the mold member 31 of the switch device 7 is also held between the upper casing 2 and the lower casing 3. The stem 5 is upwardly biased by the compression spring 6 to the uppermost position as shown in FIG. 1. Under this normal or rest condition of the stem 5, the contacts 25*a* and 26*a* of the switch device 7 are open.

When the stem 5 is depressed from the rest condition, the abutment between the projection 5*a* of the stem 5 and the projection 27*a* of the spring plate portion 27 is released to restore the unloaded condition of the spring plate portion 27 and thereby allow the same to separate from the movable contact plate 26. As a result, the contacts 25*a* and 26*a* are closed to establish the on-state of the switch device 7 as shown in FIG. 2. On the other hand, the spring portion 10 of the clicking leaf spring 8 is urged by the stem 5 during the lowering movement thereof, and is deformed from the spring fulcrum 23 in a clockwise direction as viewed in FIG. 2. When the stem 5 reaches its nearly lowermost position corresponding to a maximum stroke, the lower end of the stem 5 rides over the stepped portions 11 of the spring portion 10. At this movement, an operator can feel clicking and sensitively recognize the switching of the switch device 7 to the on-state. Thereafter, when a depression force applied to the stem 5 is removed, the stem 5 is returned to the rest position by a return force of the compression spring 6. Accordingly, the contacts 25*a* and 26*a* are opened again by the spring plate portion 27, and the leaf spring 10 is also returned to its initial condition.

As described above, the elastic deformation of the spring portion 10 of the clicking leaf spring 8 is permitted from the spring fulcrum 23. Therefore, even when the height of the push button switch is small, a deformation span $S_2$ defined as a length between the spring fulcrum 23 and the free end of the spring portion 10 can be made sufficiently large as shown in FIG. 4, thereby obtaining a suitable spring force without reducing the thickness of the clicking leaf spring 8. Thus, the push button switch may be made compact with a high reliability.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. In a push button switch including a casing unit composed of a first casing and a second casing, a switch device provided in said casing unit, a stem slidably supported by said casing unit for switching on and off said switch device, biasing means for normally elastically biasing said stem in such a direction as to restore an initial condition of said stem, and a clicking leaf spring adapted to abut against said stem for giving a click feeling to an operator upon depression of said stem;

an improvement wherein said clicking leaf spring comprises:

a base portion having opposite ends abutting against opposed inner surfaces of said first casing and said second casing and thereby being held between said first casing and said second casing, said base portion further having at least two curved portions formed at opposite side edges adapted to elastically abut against the inner surface of said first casing such that said base portion may be fixedly positioned in said first casing with respect to a lateral direction.

and a spring portion split from said base portion by a pair of slits having closed ends, the straight-line distance between said spring portion being bent such that said spring portion is removed from both said first casing and said second casing, thereby allowing said spring portion to bend at said spring fulcrum, thus increasing the effective length of said spring portion.

* * * * *